US011535283B1

(12) United States Patent
Kim et al.

(10) Patent No.: US 11,535,283 B1
(45) Date of Patent: Dec. 27, 2022

(54) TRAIN DERAILMENT AND ROLLOVER PREVENTION SYSTEM

(71) Applicant: K-TECHNOLOGY USA, INC., Los Angeles, CA (US)

(72) Inventors: Ki Il Kim, Los Angeles, CA (US); Young Kim, Los Angeles, CA (US); Paul Kim, Beverly Hills, CA (US); Sarah Duncanson, Los Angeles, CA (US)

(73) Assignee: K-TECHNOLOGY USA, INC., Los Angeles, CA (US)

( * ) Notice: Subject to any disclaimer, the term of this patent is extended or adjusted under 35 U.S.C. 154(b) by 0 days.

(21) Appl. No.: 17/883,034

(22) Filed: Aug. 8, 2022

(51) Int. Cl.
*B61F 9/00* (2006.01)
*B61F 11/00* (2006.01)

(52) U.S. Cl.
CPC ..... *B61F 9/005* (2013.01); *B61F 11/00* (2013.01)

(58) Field of Classification Search
CPC ..... B61F 9/00; B61F 9/005; B61F 11/00
USPC ..... 105/72.2, 77, 78, 215.1
See application file for complete search history.

(56) References Cited

U.S. PATENT DOCUMENTS 379,815 A * 3/1888 Ries ..... B61C 15/00 105/76
731,365 A * 6/1903 Honey ..... F16L 55/32 105/78
764,856 A * 7/1904 Mahoney ..... B60M 1/103 191/63
794,151 A * 7/1905 Lowry ..... 105/215.1
801,532 A * 10/1905 Lowry ..... 105/215.1
2,124,125 A * 7/1938 Schoepf ..... B61H 7/08 303/3
3,810,515 A * 5/1974 Ingro ..... A63H 11/04 446/457
11,268,474 B2 3/2022 Sankara et al.

* cited by examiner

*Primary Examiner* — Zachary L Kuhfuss
(74) *Attorney, Agent, or Firm* — Novick, Kim & Lee PLLC; Jae Youn Kim

(57) ABSTRACT

Proposed is a train derailment and rollover preventing system to improve train safety. To prevent derailment and rollover of a train vehicle, the train vehicle can have a magnetic roller coupled to a magnet roller holder which can space apart the magnetic roller from the wheel. The wheel may be coupled to a wheel shaft which may be coupled to a train vehicle chassis and the magnetic roller holder may be coupled to the train vehicle chassis. The magnetic roller holder may include a shock adsorber positioned between the train vehicle chassis and the magnetic roller. The magnetic roller may include at least one of a permanent magnet or an electric magnet to supply a magnetic force. The magnetic force may be in a range of one hundred pounds pulling force to five thousand pounds pulling force. A train vehicle may be a locomotive or a train car in a train.

19 Claims, 5 Drawing Sheets

TRAIN DERAILMENT AND ROLLOVER PREVENTION SYSTEM

1. FIELD OF THE INVENTION

One or more embodiments of the present invention relate to a train derailment and rollover prevention system for preventing derailment and rollover of trains to improve train safety.

2. DESCRIPTION OF THE RELATED ART

A large number of products and people utilize trains to move from one destination to another. According, train safety is of paramount importance. Train derailment is a common cause of train accidents causing injury to people and damage to trains and the freight transported by trains. A train derailment could lead to a rollover of the train, which would cause additional damage.

Some of the most common causes of train derailment include misaligned or broken rails, sharp turning curves, defective rails, defective rail gaps, defective welds related to the rail, and too much speed.

Accordingly, there is a need for a new system for preventing derailment and rollover of trains to improve train safety to protect people from injury as well as to prevent damage to trains and the freight transported by trains.

SUMMARY OF THE INVENTION

In consideration of the above problems, for saving life and property, one aspect of the present invention is to propose adding one or more magnetic rollers to a train vehicle chassis (train vehicle body) of one or more train vehicles of a train to provide a strong magnetic force between the magnetic rollers and one or more rails to prevent derailment and rollover of the train.

As an embodiment of the present invention, a train derailment and rollover prevention system for a train vehicle is proposed. This system may include: a wheel shaft coupled to a train vehicle chassis of the train vehicle; a wheel coupled to the wheel shaft, wherein the wheel is configured to rotate on a rail; a magnetic roller holder spaced apart from the wheel and coupled to the train vehicle chassis; and a magnetic roller coupled to the magnetic roller holder, wherein the magnetic roller is spaced apart from the wheel and wherein the magnetic roller is capable of touching the rail and capable of rotating on the rail.

The magnetic roller holder may include a shock adsorber positioned between the train vehicle chassis and the magnetic roller.

The train derailment and rollover prevention system holds the train vehicle to the rail during a crash.

The system may further include one or more additional magnetic rollers. The magnetic roller holder may be coupled to the one or more additional magnetic rollers which touch the rail and are capable of rotating on the rail.

The wheel and the shaft are both part of a bogie, which is coupled to the train vehicle chassis.

The magnetic roller has a magnetic roller protection cover to partially cover the magnetic roller.

The magnetic roller has one or more demagnetized portions.

The magnetic roller may include at least one of a permanent magnet and an electric magnet.

A total weight of the train derailment and rollover prevention system is loaded onto the rail.

The magnetic roller includes a magnetic force in a range of one hundred pounds pulling force to five thousand pounds pulling force.

The train vehicle has wheels coupled on a first side of the train vehicle and a second side of the train vehicle, wherein twelve magnetic rollers are coupled to the first side of the train vehicle and twelve magnetic rollers are coupled to the second side of the train vehicle through magnetic roller holders, and wherein each magnetic roller applies at least four thousand pounds of pulling force.

The train vehicle is one of a train car and a locomotive.

The train car may be one of a caboose; a coal car; a passenger car; a box car; a refrigerated box car; a center-beam car; a covered hopper car; an oil car; a flat car; a gondola car; an intermodal equipment car; an open-top hopper car; a tank car; a subway car; a well car; and a train trailer.

The magnetic roller is coated with one of graphene, metal, and plastic.

The magnetic roller is a double magnetic roller.

The magnetic roller is spaced apart from at least one wheel by at least one-quarter of an inch.

The system may further include a stopper coupled to a shock adsorber through the train vehicle chassis to accommodate at least four thousand pounds of pulling force supplied by the magnet roller coupled to the shock absorber through the magnetic roller holder, wherein the stopper is forced against the train vehicle chassis during a crash.

As an embodiment of the present invention, a train derailment and rollover prevention system for a train vehicle is provided. The system may include a wheel shaft coupled to a train vehicle chassis of the train vehicle; a plurality of wheels coupled to the wheel shaft, wherein the plurality of wheels is configured to rotate on a rail; a plurality of magnetic roller holders spaced apart from the plurality of wheels and coupled to the train vehicle chassis; and a magnetic roller coupled to each magnetic roller holder, wherein each magnetic roller is spaced apart from the plurality of wheels and wherein each magnetic roller touches the rail and is capable of rotating on the rail.

The train derailment and rollover system for the train vehicle holds the train vehicle to the rail during a crash.

Each magnetic roller includes a magnetic force in a range of one hundred pounds pulling force to five thousand pounds pulling force.

Additional aspects will be set forth in part in the description which follows and, in part will be apparent from the description, or may be learned by practice of the presented embodiments.

BRIEF DESCRIPTION OF THE DRAWINGS

These and other aspects will become apparent and more readily appreciated from the following description of the embodiments, taken in conjunction with the accompanying drawings of which.

The features and advantages of the present invention will become more apparent from the detailed description set forth below when taken in conjunction with the drawings in which like reference numerals indicate identical or functionally similar elements.

DETAILED DESCRIPTION

Figure 1:
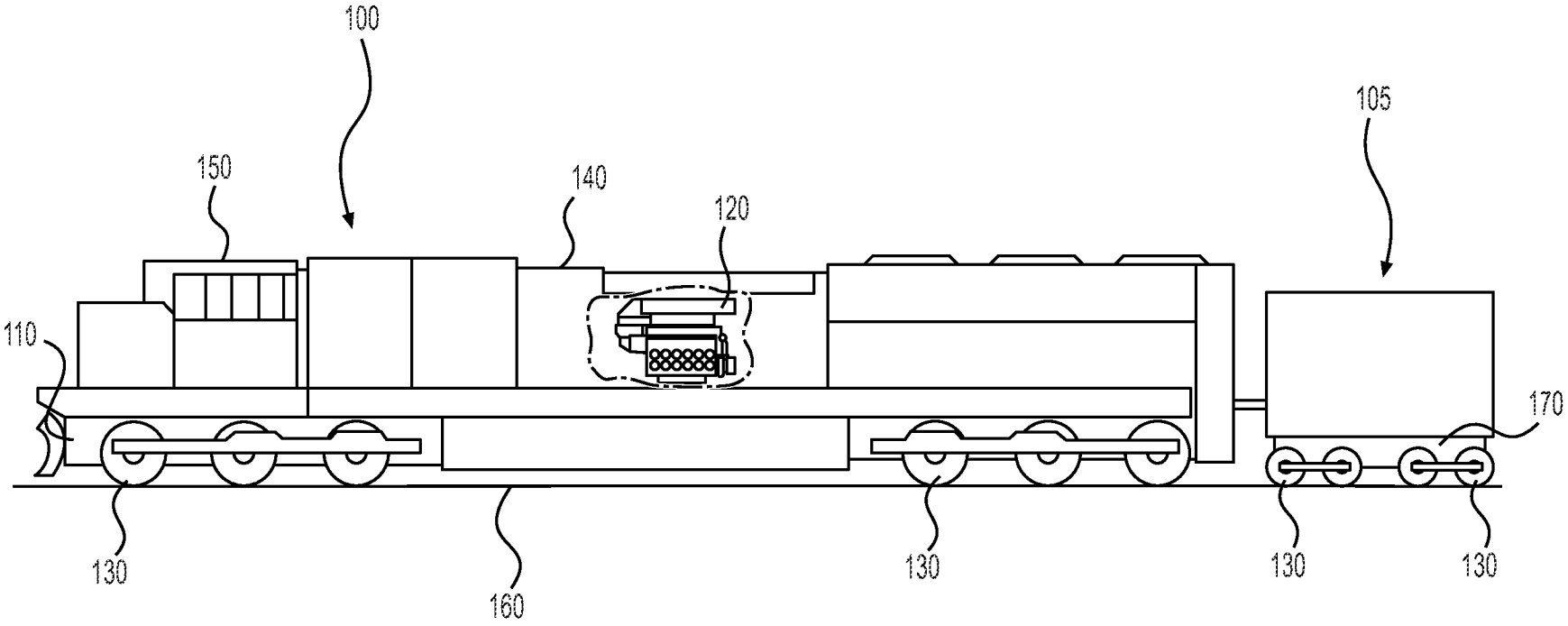
FIG. 1 illustrates a side view of a locomotive and train car forming a train.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below by referring to the figures, to explain aspects of the present description. Terms used herein are for descriptive purposes only and are intended to limit the scope of the invention. The terms "comprises" and/or "comprising" are used to specify the presence of stated elements, steps, operations, and/or components, but do not preclude the presence or addition of one or more elements, steps, operations, and/or components. The terms "first," "second," and the like may be used to describe various elements, but do not limit the elements. Such terms are used only to classify one element from another.

It is noted that wherever practicable, similar or like reference numbers may be used in the drawings and may indicate similar or like elements.

Referring to FIG. 1, FIG. 1 illustrates two examples of train vehicles. A train vehicle may be a locomotive 100 or a train car 105. FIG. 1 illustrates a side view of a locomotive 100 and train car 105 forming an example of a train to which embodiments of the present invention may be applied to prevent derailment and rollover of trains to improve train safety. A locomotive 100 is an engine car which provides motive power for one or more train cars 105 which are collectively referred to as a train. The locomotive 100 may be any type of car providing motive power to move the train. For example, the locomotive 100 may be powered by electrical power, steam, and fossil fuels such as diesel. Electrical power may be supplied by batteries and/or power lines for example. However, all motive power is contemplated. The locomotive 100 may be operated by train operators for operating or monitoring the train or the locomotive 100 may be operated autonomously.

In the example in FIG. 1, a locomotive 100 may include a chassis (body) 110, an engine 120 supported by the chassis 110, wheels 130 supporting the chassis 110 and driven by the engine 120, and an envelope 140 covering at least the chassis 110 and the engine 120. Wheels 130 may be made of different materials including steel and may be coupled to a wheel shaft, which is coupled to a chassis 110. An envelope 140 of the locomotive 100 is an outline of the space occupied by the locomotive 100 when in motion, including the effects of tilt, sway, track cant, etc. The locomotive 100 also includes a cab 150 which is a control center for the train. The cab 150 may be accessible to train operators for operating the train or monitoring the train. The cab 150 may also be the control center for an autonomous operation of the train. In addition to wheels 130 supporting chassis 110, wheels 130 may rest or rotate on rails 160.

In the example in FIG. 1, a train car 105 includes a train car chassis (train car body) 170 and wheels 130 supporting the train car chassis (train car body) 170 as well as resting or rotating on rails 160. A train car 105 may be forty to fifth feet in length. Wheels 130 may be made of different materials including steel and may be coupled to a wheel shaft, which is coupled to a train car chassis (train car body) 170. All train vehicles including train cars 105 also have an envelope. A train car 105 may be one of a caboose, a coal car; a passenger car; a box car; a refrigerated box car; a centerbeam car; a covered hopper car; an oil car; a flat car; a gondola car; an intermodal equipment car; an open-top hopper car; a tank car; a subway car; a well car; and a train trailer.

One or more wheels 130 may be part of an assembly such as a bogie, which is coupled to a chassis (body) of a train vehicle. Examples of a train vehicle chassis include locomotive chassis 110 and train car chassis 170. A bogie is a framework that may carry a wheelset (group of wheels 130) which is part of a train vehicle (i.e., a modular subassembly of wheels and axles which are part of a train vehicle). The bogie may include a suspension or may be solid and in turn be suspended. The bogie may be mounted on a swivel, as traditionally on a train vehicle. One or more wheels 130 may be coupled to a chassis of a train vehicle through a wheel shaft. A bogie is an example of an assembly which may couple one or more wheels 130 to a train vehicle chassis (train vehicle body) so that the train vehicle chassis (train vehicle body) is supported by the wheels 130. The wheel 130 and the wheel shaft may both be part of a bogie, which may be coupled to the train vehicle chassis.

Figure 2:
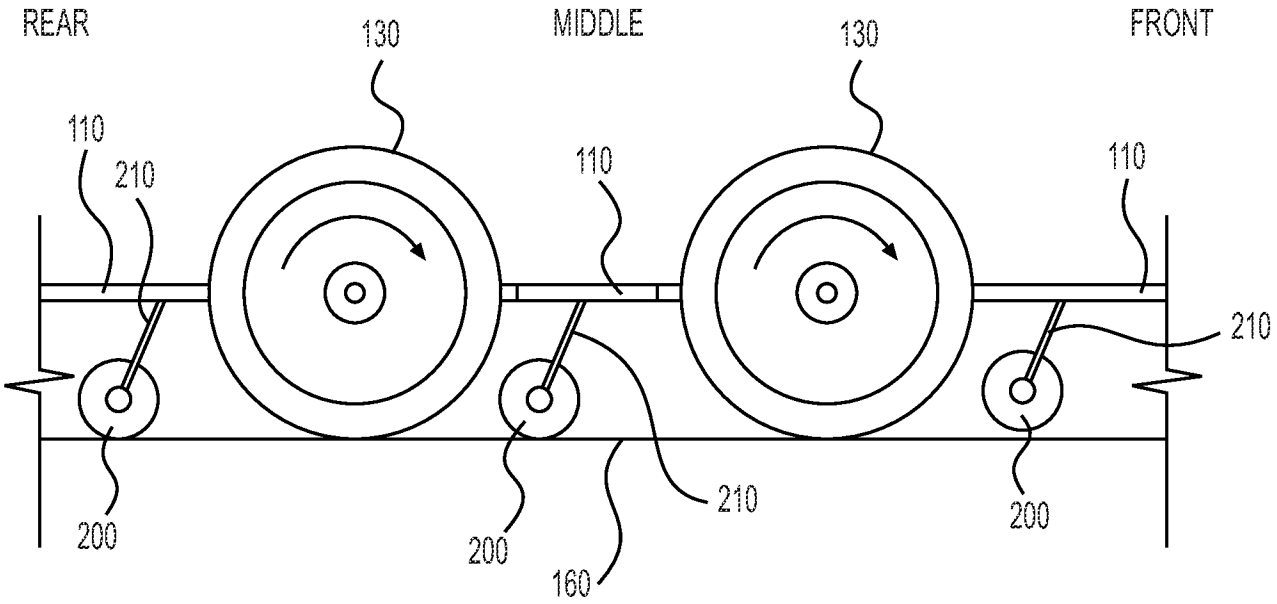
FIG. 2 illustrates a side view of an embodiment of a train derailment and rollover prevention system to be applied to one or more train vehicles such as a train car and a locomotive.

Referring to FIG. 2, FIG. 2 illustrates a side view of an embodiment of a train derailment and rollover prevention system to be applied to one or more train vehicles such as a train car 105 and a locomotive 100. In the example in FIG. 2, a magnetic roller 200 is coupled to a magnetic roller holder 210, which is coupled to a train vehicle chassis such as locomotive chassis 110. Although FIG. 2 shows a locomotive chassis 110 as an example of a train vehicle chassis, embodiments include any train vehicle chassis including train car chassis 170. The magnetic roller 200 may be coated with a graphene, a metal or a plastic material. The magnetic roller 200, which is coupled to a magnetic roller holder 210, is spaced apart from the wheel 130. A wheel 130 in FIGS. 2-5 may denote a train vehicle wheel of any train vehicle such as locomotive 100 or train car 105. The magnetic roller 200 may be spaced apart from the wheel 130 by at least one quarter of an inch. The magnetic roller 200 touches the rail 160 and is capable of rotating on the rail 160 as one or more wheels 130 of the train vehicle moves. Further, the magnetic roller holder 210 may be configured to adjust the distance of the magnetic roller 200 from the rail 160.

The magnetic roller 200 includes magnetic force, which may be in a range of one hundred pounds pulling force to five thousand pounds pulling force to hold the train vehicle onto rails 160 during a crash. The magnetic roller 200 may include a permanent magnet, an electric magnet, or a combination thereof. The amount of magnetic force may be dependent upon the diameter of wheel 130.

FIG. 2 shows more than one magnetic roller holders 210 coupled to a magnetic roller 200 and to the chassis 110 at various locations on the chassis 110. FIG. 2 shows magnetic roller holders 210 coupled to a chassis 110. One or more of the magnetic roller holders 210 may be coupled to any train vehicle chassis (train vehicle body). Accordingly, one or more magnetic rollers 200 may be coupled to one or more magnetic roller holders 210 which are coupled to any train vehicle chassis (train vehicle body). For example, twenty-four magnetic rollers 200 can be installed on sides of any train vehicle chassis. The twenty-four magnetic rollers may be capable of receiving 4000 pounds each or 96,000 pounds of pulling force that holds the train vehicle to rails during a crash. This configuration may provide about two hundred forty pounds loaded on the rails (resting on the rails). The train vehicle chassis does not carry the weight of this load.

Figure 3:
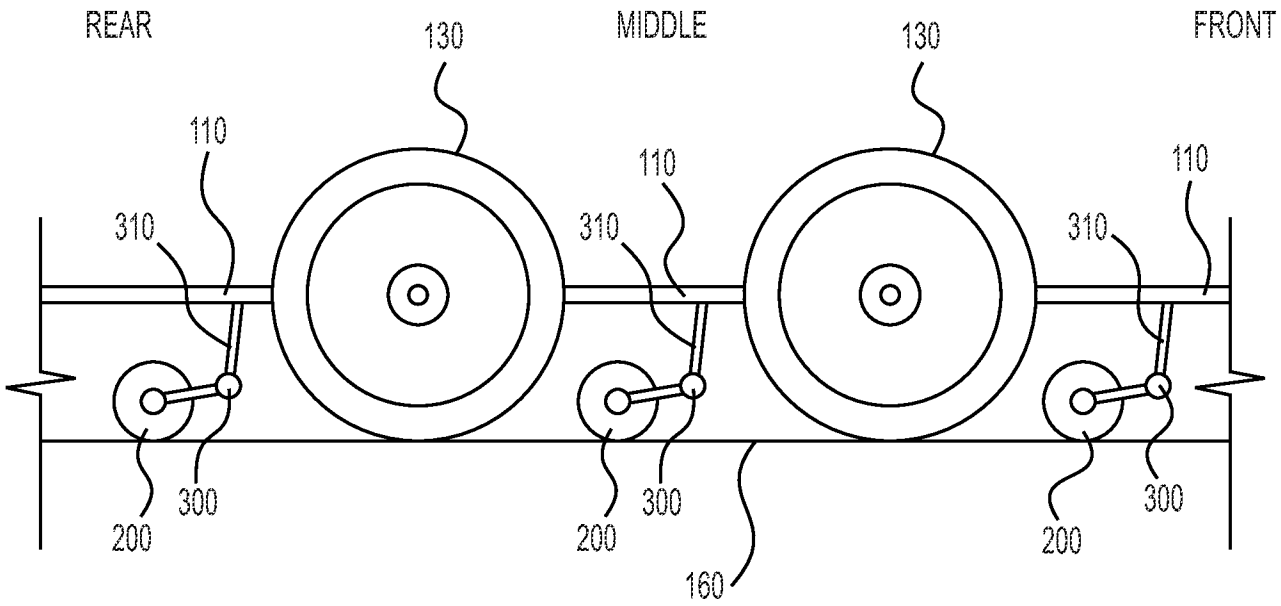
FIG. 3 illustrates a side view of an embodiment of a train derailment and rollover prevention system to be applied to one or more train vehicles such as a train car and a locomotive.

Referring to FIG. 3, FIG. 3 illustrates a side view of an embodiment of a train derailment and rollover prevention system to be applied to one or more train vehicles such as a train car 105 and a locomotive 100. FIG. 3 shows a magnetic roller holder 310 including a shock adsorber 300 to lessen the shock caused by the magnetic roller 200 touching and rotating on the rail 160. The shock adsorber 300 of the magnetic roller holder 310 is positioned between the magnetic roller 200 and the chassis 110. Further, the magnetic roller holder 310 may be configured to adjust the distance of the magnetic roller 200 from the rail 160. In addition, one or more of the magnetic roller holders 310 of FIG. 3 may be coupled to any train vehicle chassis (train vehicle body). The chassis 110, the rail 160, the magnetic rollers 200, and the wheels 130 shown in FIG. 3 are the same as the chassis 100, the rail 160, magnetic rollers 200, and wheels 130 shown in FIG. 2 Although FIG. 3 shows a locomotive chassis 110 as an example of a train vehicle chassis, embodiments include any train vehicle chassis including train car chassis 170.

Figure 4:
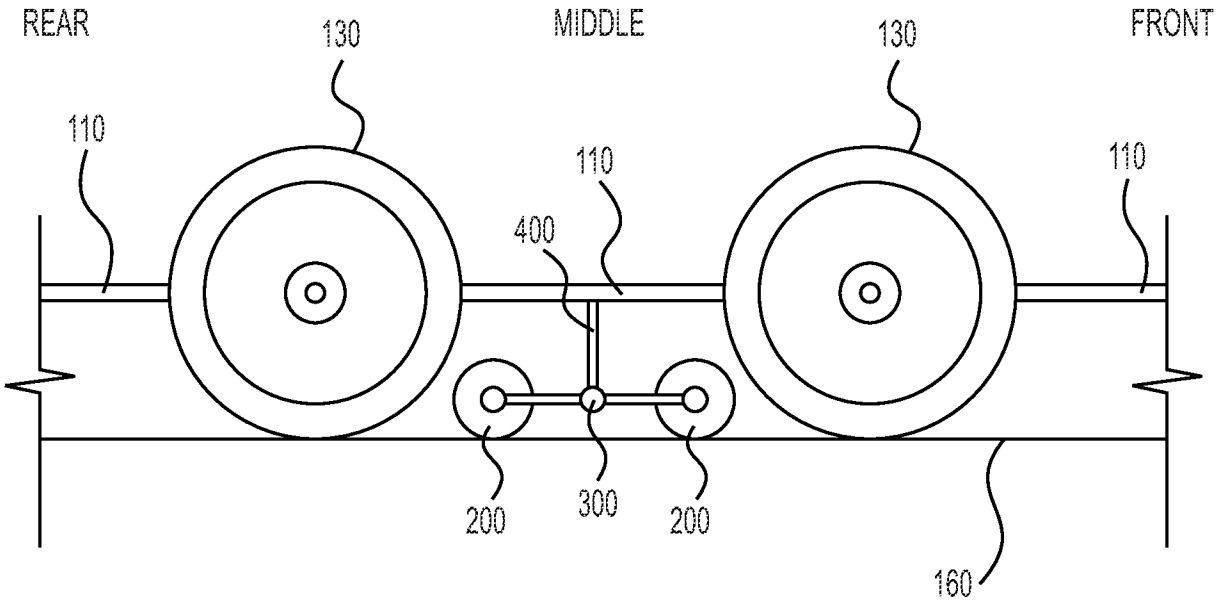
FIG. 4 illustrates a side view of an embodiment of a train derailment and rollover prevention system to be applied to one or more train vehicles such as a train car and a locomotive.

Referring to FIG. 4, FIG. 4 illustrates a side view of an embodiment of a train derailment and rollover prevention system to be applied to one or more train vehicles such as a train car 105 and a locomotive 100. FIG. 4 shows a magnetic roller holder 400, which is coupled to one magnetic roller 200 and an additional magnetic roller 200. However, one or more additional magnetic rollers 200 may be coupled to the magnetic roller holder 400. In addition, all magnetic rollers 200 coupled to magnetic roller holder 400 touch the rail 160 and are capable of rotating on the rail 160. Accordingly, all of the magnetic rollers 200 touch the rail 160 and may rotate on the rail 160. The magnetic roller holder 400 may also include a shock adsorber 300 to lessen the shock caused by one or more magnetic rollers 200 touching and rotating on the rail 160. Further, the magnetic roller holder 400 may be configured to adjust the distance of the magnetic roller 200 from the rail 160. In addition, one or more of the magnetic roller holders 400 of FIG. 4 may be coupled to any train vehicle chassis (train vehicle body) such as locomotive chassis 110. The chassis 110, the rail 160, the magnetic rollers 200, and the wheels 130 shown in FIG. 4 are the same as the chassis 110, the rail 160, the magnetic rollers 200, and the wheels 130 shown in FIG. 2. Although FIG. 4 shows a locomotive chassis 110 as an example of a train vehicle chassis, embodiments include any train vehicle chassis including train car chassis 170.

Figure 5:
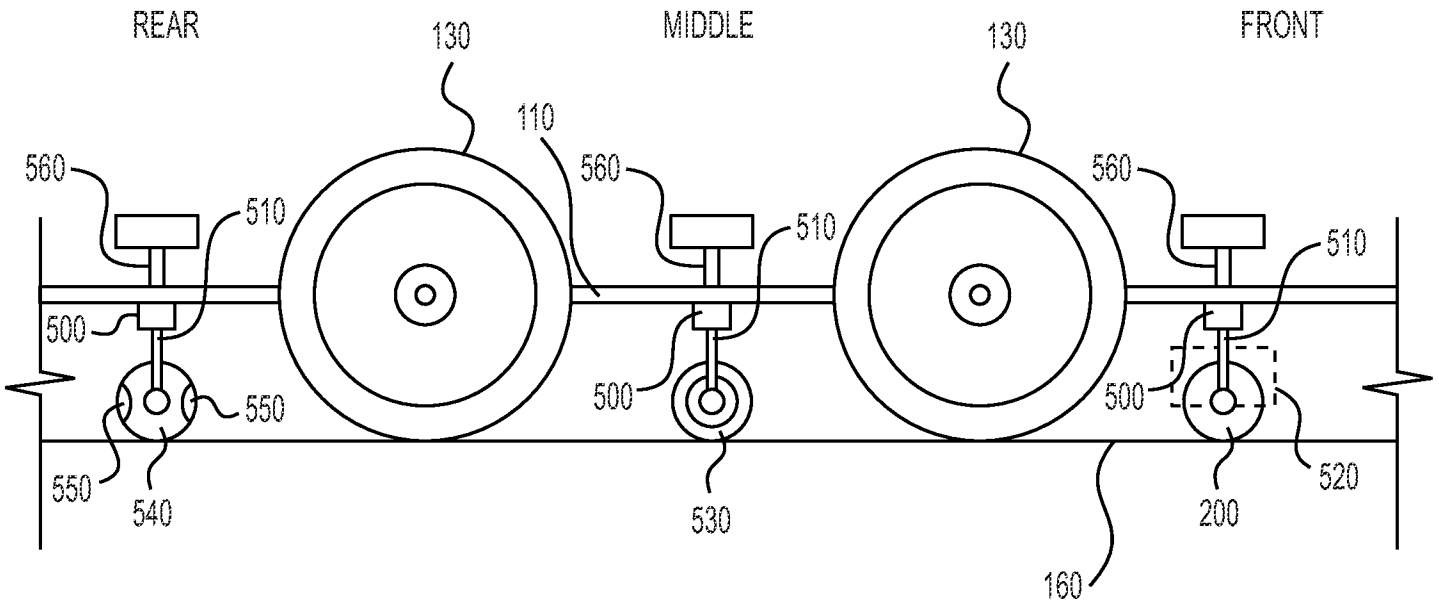
FIG. 5 illustrates a side view of an embodiment of a train derailment and rollover prevention system to be applied to one or more train vehicles such as a train car and a locomotive.

Referring to FIG. 5, FIG. 5 illustrates a side view of an embodiment of a train derailment and rollover prevention system to be applied to one or more train vehicles such as a train car 105 and a locomotive 100. FIG. 5 shows a magnetic roller holder 510 including a shock adsorber 500 to lessen the shock caused by a magnetic roller touching and rotating on the rail 160. All of the magnetic rollers shown in FIG. 5 touch the rail 160 and may rotate on the rail 160. The shock adsorber 500 may couple the magnetic roller holder 510 and to the locomotive chassis 110. Further, the magnetic roller holder 510 may be configured to adjust the distance of a magnetic roller from the rail 160. In addition, one or more of the magnetic roller holders 510 of FIG. 5 may be coupled to any train vehicle chassis (train vehicle body). Although FIG. 5 shows a locomotive chassis 110 as an example of a train vehicle chassis, embodiments include any train vehicle chassis including train car chassis 170.

Referring to FIG. 5, FIG. 5 also shows a magnetic roller protection cover 520 to partially cover a magnetic roller 200. Because some metals can be attached by magnetism to the magnetic roller 200 while a train vehicle is moving forward, the magnetic roller protection cover 520, which partially covers the magnetic roller 200, can prevent metals from attaching to the magnetic roller 200. The magnetic roller protection cover 520 may have other shapes. The magnetic roller 200 may be spaced apart from at least one wheel by at least one-quarter of an inch. The magnetic roller protection cover 520 may be used to protect any magnetic roller in any embodiment.

Referring to FIG. 5, FIG. 5 also shows an alternative embodiment of a magnetic roller denoted by reference numeral 530. Magnetic roller 530 is a double roller. The magnetic roller 530 may be coated with a graphene, a metal or a plastic material. The magnetic roller protection cover 520 may also partially cover magnetic roller 530. The magnetic roller 530 may be spaced apart from at least one wheel by at least one-quarter of an inch.

Referring to FIG. 5, FIG. 5 also shows an alternative embodiment of a magnetic roller denoted by reference numeral 540. Magnetic roller 540 includes one or more de-magnetized portions 550. The remaining portion of magnetic roller 530 may be magnetized. The one or more demagnetized portions 550 cause the rotation of magnetic roller 540 to rotate more efficiently on rails 160. More specifically, the remaining magnetic portion of the magnetized roller 540 pulls or forces the wheel 130 toward the rail 160, which holds the wheel 130 to the rail 160. The demagnetized portions 550 release the wheel 130 from the magnetic force pulling the wheel 130 toward the rail 160. Accordingly, the wheel 130 is not pulled to the rail 160 all of the time by a magnetic force. Because the wheel 130 is not magnetically forced to rail 160 all of the time, the train vehicle such as locomotive 100 and train car 105 move more efficiently on rail 160. In addition, the magnetic roller protection cover 520 may also partially cover magnetic roller 540, and the magnetic roller 540 may be spaced apart from at least one wheel 130 by at least one-quarter of an inch.

Referring to FIG. 5, FIG. 5 also shows stoppers 560, which are coupled to shock adsorbers 500 through chassis 110 of any train vehicle including locomotive 100 and train car 105. The stoppers 560 are made of a hard material such as a carbon material, a metal or a plastic. A stopper 560 must be able to accommodate at least four thousand pounds (4000 pounds) of pulling force. The stoppers 560 may be applied against the chassis 110 during a crash as part of the train derailment and rollover prevention system to prevent the train vehicle form derailing and rolling over during a crash.

Further, one or more of the magnetic roller holders 210 shown in FIG. 2, one or more of the magnetic roller holders 310 shown in FIG. 3, one or more of the magnetic roller holders 400 shown in FIG. 4, and one or more of the magnetic roller holders 510 shown in FIG. 5 may be coupled to any train vehicle chassis (train vehicle body), so that magnetic rollers 200, 530, and 540 can apply a pulling force to encourage one or more wheels 130 (or one or more assemblies including one or more wheels) to remain on the rail 160 during a crash.

It should be understood that the exemplary embodiments described herein should considered in a description sense only and not for purposes of limitation. Descriptions of features or aspects within each embodiment should typically be considered as available for other similar features or aspects in other embodiments.

What is claimed is:

1. A train derailment and rollover prevention system for a train vehicle, the train derailment and rollover prevention system comprising:

a wheel shaft coupled to a train vehicle chassis of the train vehicle;

a wheel coupled to the wheel shaft, wherein the wheel is configured to rotate on a rail;

a magnetic roller holder spaced apart from the wheel and coupled to the train vehicle chassis; and a magnetic roller coupled to the magnetic roller holder, wherein the magnetic roller is spaced apart from the wheel and wherein the magnetic roller touches the rail and is capable of rotating on the rail, wherein the magnetic roller has one or more demagnetized portions.

2. The train derailment and rollover prevention system of claim 1, wherein the magnetic roller holder includes a shock absorber positioned between the train vehicle chassis and the magnetic roller.

3. The train derailment and rollover prevention system of claim 1, wherein the train derailment and rollover system for the train vehicle holds the train vehicle to the rail during a crash.

4. The train derailment and rollover prevention system of claim 1, further comprising one or more additional magnetic rollers, wherein the magnetic roller holder is coupled to the one or more additional magnetic rollers which touch the rail and which are capable of rotating on the rail.

5. The train derailment and rollover prevention system of claim 1, wherein the wheel and the wheel shaft are both part of a bogie, which is coupled to the train vehicle chassis.

6. The train derailment and rollover prevention system of claim 1, wherein the magnetic roller has a magnetic roller protection cover to partially cover the magnetic roller.

7. The train derailment and rollover prevention system of claim 1, wherein the magnetic roller includes at least one of a permanent magnet and an electric magnet.

8. The train derailment and rollover prevention system of claim 1, wherein a total weight of the train derailment and rollover prevention system is loaded onto the rail.

9. The train derailment and rollover prevention system of claim 1, wherein the magnetic roller includes a magnetic force in a range of one hundred pounds pulling force to five thousand pounds pulling force.

10. The train derailment and rollover prevention system of claim 1, wherein the train vehicle has wheels coupled on a first side of the train vehicle and a second side of the train vehicle, wherein twelve magnetic rollers are coupled to the first side of the train vehicle and twelve magnetic rollers are coupled to the second side of the train vehicle through magnetic roller holders, and wherein each magnetic roller applies at least four thousand pounds of pulling force.

11. The train derailment and rollover prevention system of claim 1, wherein the train vehicle is one of a train car and a locomotive.

12. The train derailment and rollover prevention system of claim 11, wherein the train car is one of a caboose, a coal car; a passenger car; a box car; a refrigerated box car; a center-beam car; a covered hopper car; an oil car; a flat car; a gondola car; an intermodal equipment car; an open-top hopper car; a tank car; a subway car; a well car; and a train trailer.

13. The train derailment and rollover prevention system of claim 1, wherein the magnetic roller is coated with one of graphene, metal, and plastic.

14. The train derailment and rollover prevention system of claim 1, wherein the magnetic roller is a double magnetic roller.

15. The train derailment and rollover presentation system of claim 1, wherein the magnetic roller is spaced apart from at least one wheel by at least one-quarter of an inch.

16. The train derailment and rollover presentation system of claim 1, further comprising a stopper coupled to a shock absorber through the train vehicle chassis to accommodate at least four thousand pounds of pulling force supplied by the magnet roller coupled to the shock absorber through the magnetic roller holder, wherein the stopper is forced against the train vehicle chassis during a crash.

17. A train derailment and rollover prevention system for a train vehicle, the train derailment and rollover preventing system comprising:

a wheel shaft coupled to a train vehicle chassis of the train vehicle;

a plurality of wheels coupled to the wheel shaft, wherein the plurality of wheels is configured to rotate on a rail;

a plurality of magnetic roller holders spaced apart from the plurality of wheels and coupled to the train vehicle chassis; and a magnetic roller coupled to each magnetic roller holder, wherein each magnetic roller is spaced apart from the plurality of wheels and wherein each magnetic roller touches the rail and is capable of rotating on the rail, wherein the magnetic roller has one or more demagnetized portions.

18. The train derailment and rollover prevention system of claim 17, wherein the train derailment and rollover system for the train vehicle holds the train vehicle to the rail during a crash.

19. The train derailment and rollover prevention system of claim 17, wherein each magnetic roller includes a magnetic force in a range of one hundred pounds pulling force to five thousand pounds pulling force.

* * * * *